United States Patent [19]

Garrett

[11] Patent Number: 4,561,508

[45] Date of Patent: Dec. 31, 1985

[54] ROLLER-REAMER

[75] Inventor: William R. Garrett, Coldspring, Tex.

[73] Assignee: Hughes Tool Company, Houston, Tex.

[21] Appl. No.: 580,689

[22] Filed: Feb. 16, 1984

Related U.S. Application Data

[63] Continuation-in-part of Ser. No. 174,515, Aug. 1, 1980, abandoned, and a continuation-in-part of Ser. No. 246,210, Mar. 21, 1983.

[51] Int. Cl.[4] ..... E21B 10/30; E21B 10/22

[52] U.S. Cl. ..... 175/347; 175/228; 175/371

[58] Field of Search ..... 175/228, 343, 344, 346, 175/347, 345, 348, 354, 371

[56] References Cited

U.S. PATENT DOCUMENTS

| | | | |
|---|---|---|---|
| 2,026,323 | 12/1935 | Reed | 175/346 |
| 2,189,031 | 2/1940 | Harrington | 175/346 |
| 2,695,771 | 11/1954 | Salvatori et al. | 175/346 |
| 3,306,381 | 2/1967 | Garrett et al. | 175/346 |
| 4,182,425 | 1/1980 | Garrett | 175/228 |
| 4,226,291 | 10/1980 | Spelts | 175/347 |
| 4,254,839 | 3/1981 | Schpok et al. | 175/345 |
| 4,261,426 | 4/1981 | Garrett | 175/346 |
| 4,262,760 | 4/1981 | Allison et al. | 175/347 |

*Primary Examiner*—Stephen J. Novosad
*Assistant Examiner*—Bruce M. Kisliuk
*Attorney, Agent, or Firm*—Vanden, Eickenroht, Thompson & Jamison

[57] ABSTRACT

A roller-reamer structure wherein for each roller shaft, the shaft is tightly, but releasably secured, both radial and thrust bearings being provided for relatively moving roller and shaft surfaces. The shaft is held in the various embodiments within accommodating slots by an interference fit between the shaft and the accommodating slot, by a partially slotted longitudinal opening that allows squeezing of a block about the shaft end, by a tapered shaft end being wedgedly held or by a slotted block opening and tapered wedging block member tightly securing the shaft. Some combinations include a sealed and protected self-lubricating reservoir.

7 Claims, 44 Drawing Figures

FIG. 9
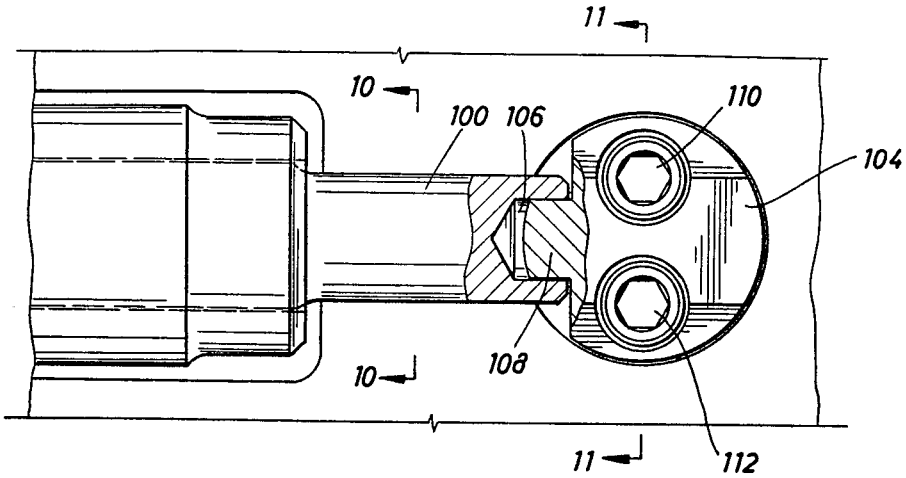
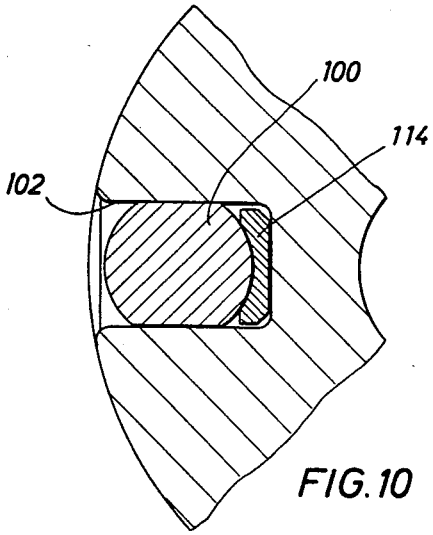
FIG. 10
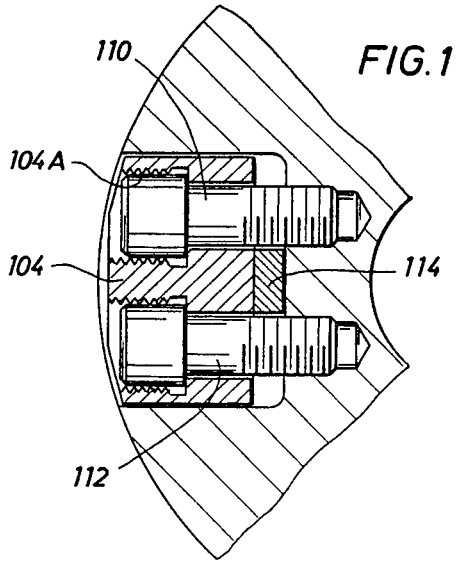
FIG. 11
FIG. 12
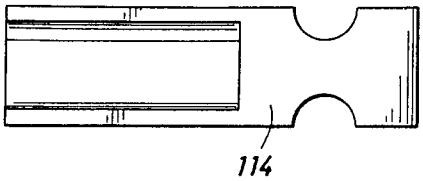
FIG. 14
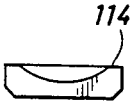
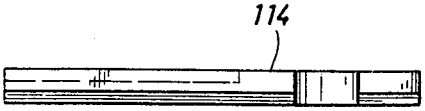
FIG. 13

FIG. 18
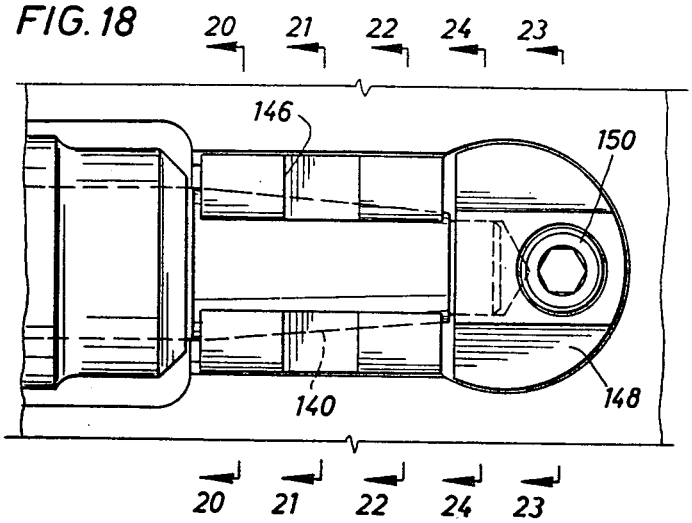
FIG. 20
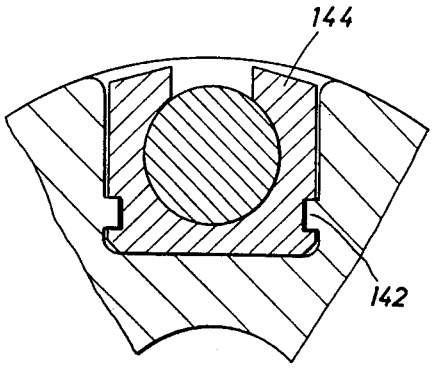
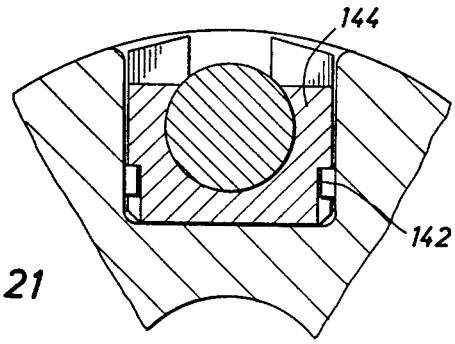
FIG. 21
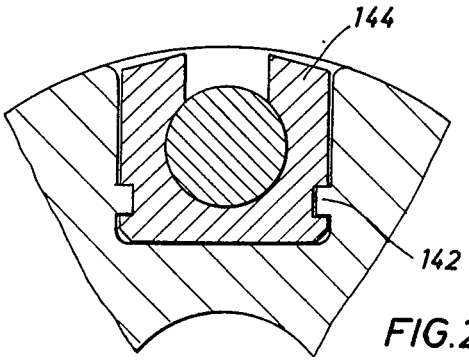
FIG. 22
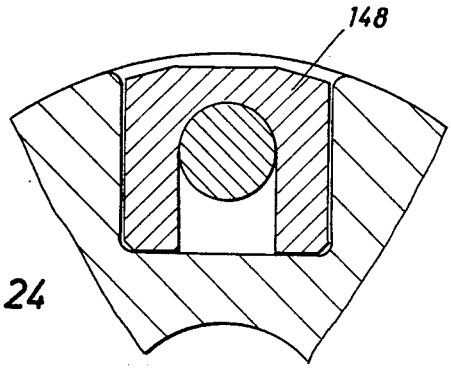
FIG. 24
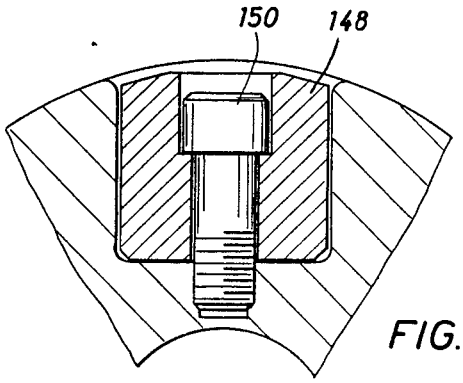
FIG. 23
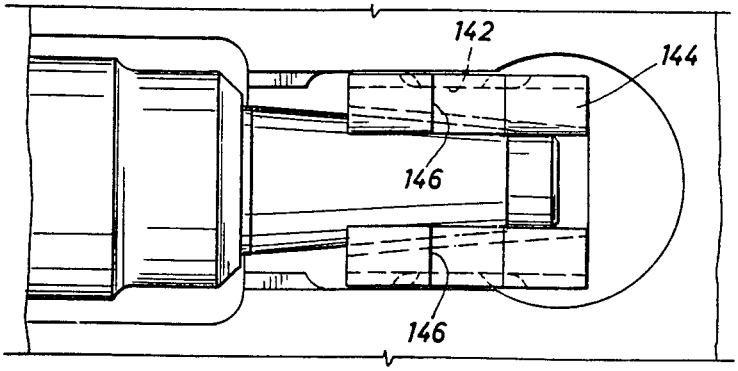
FIG. 19

FIG. 25
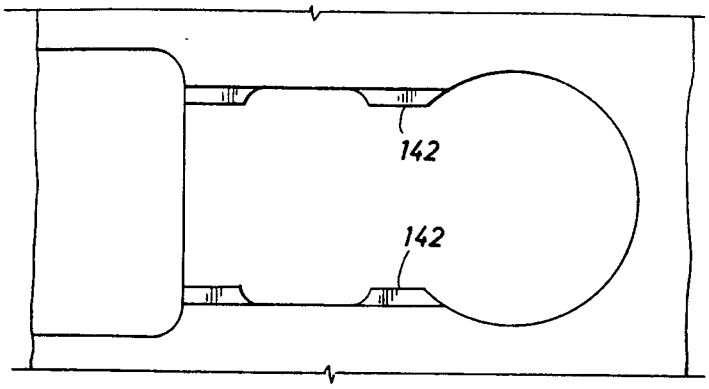
FIG. 26
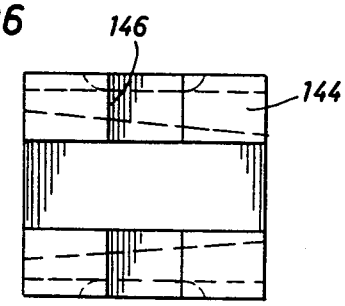
FIG. 27
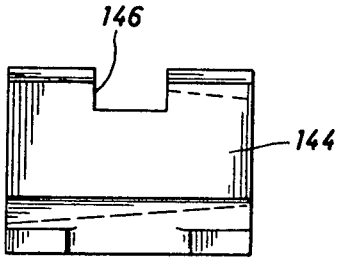
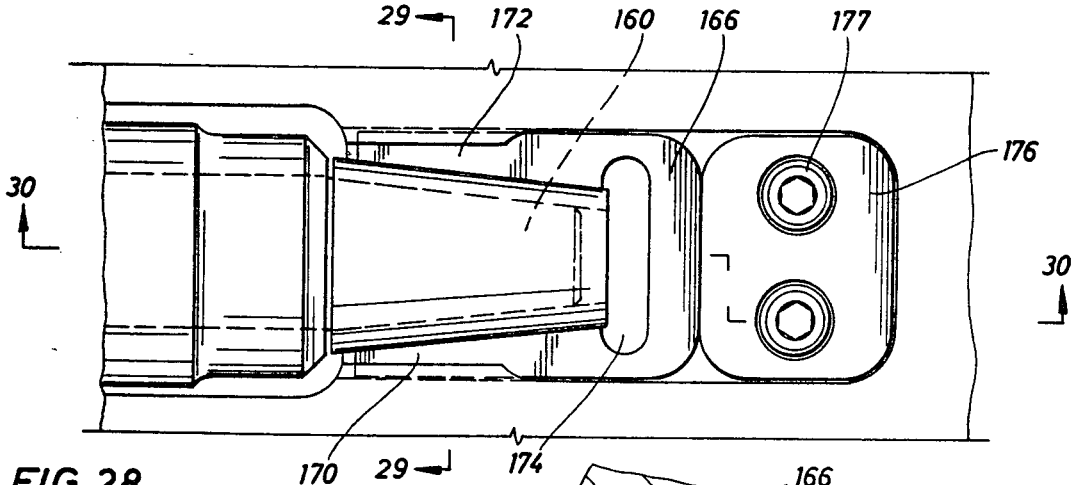
FIG. 28
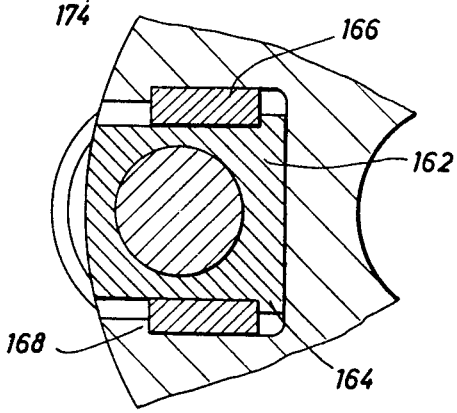
FIG. 29

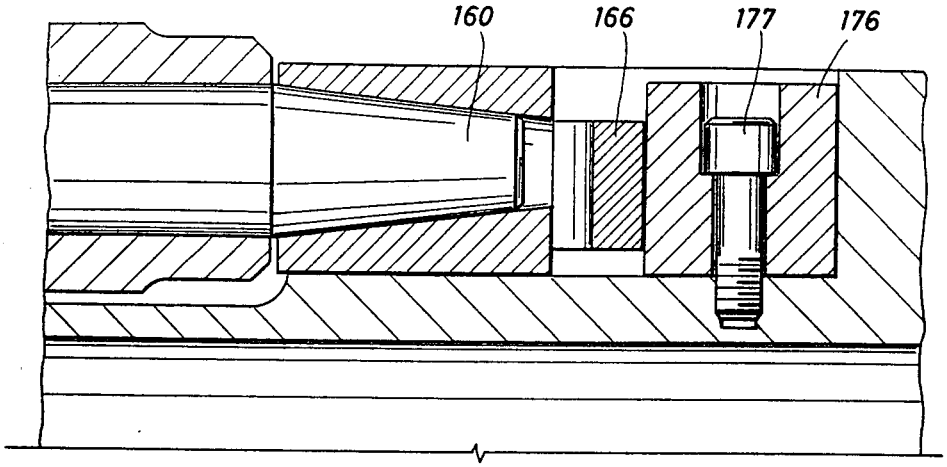
FIG. 30
FIG. 31
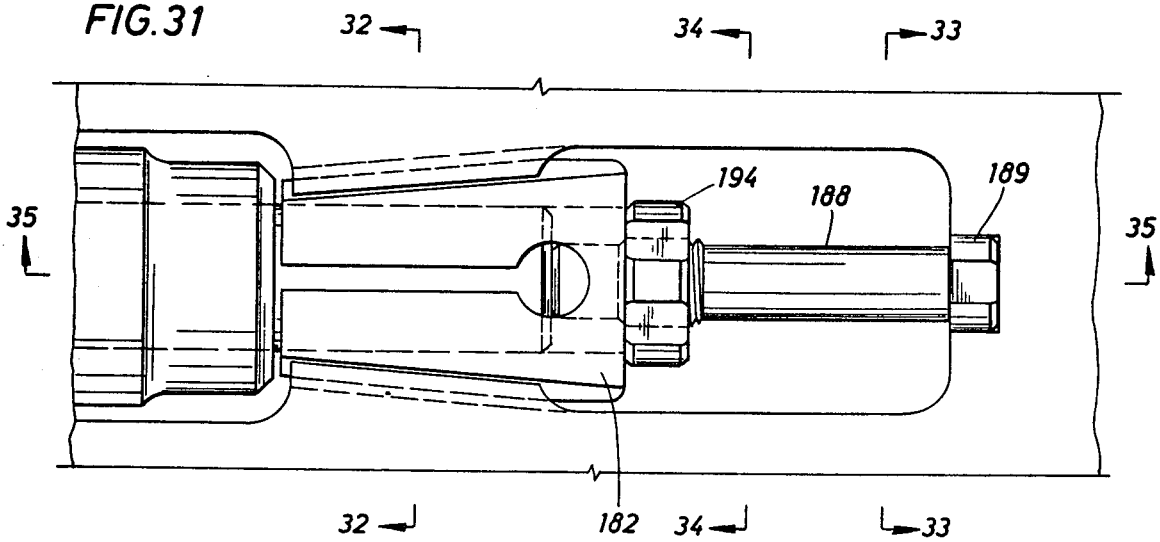
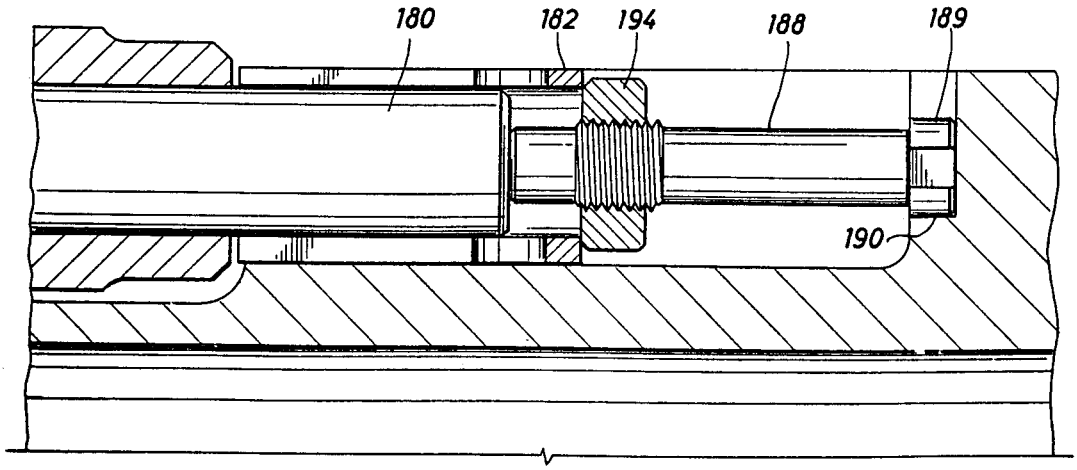
FIG. 35

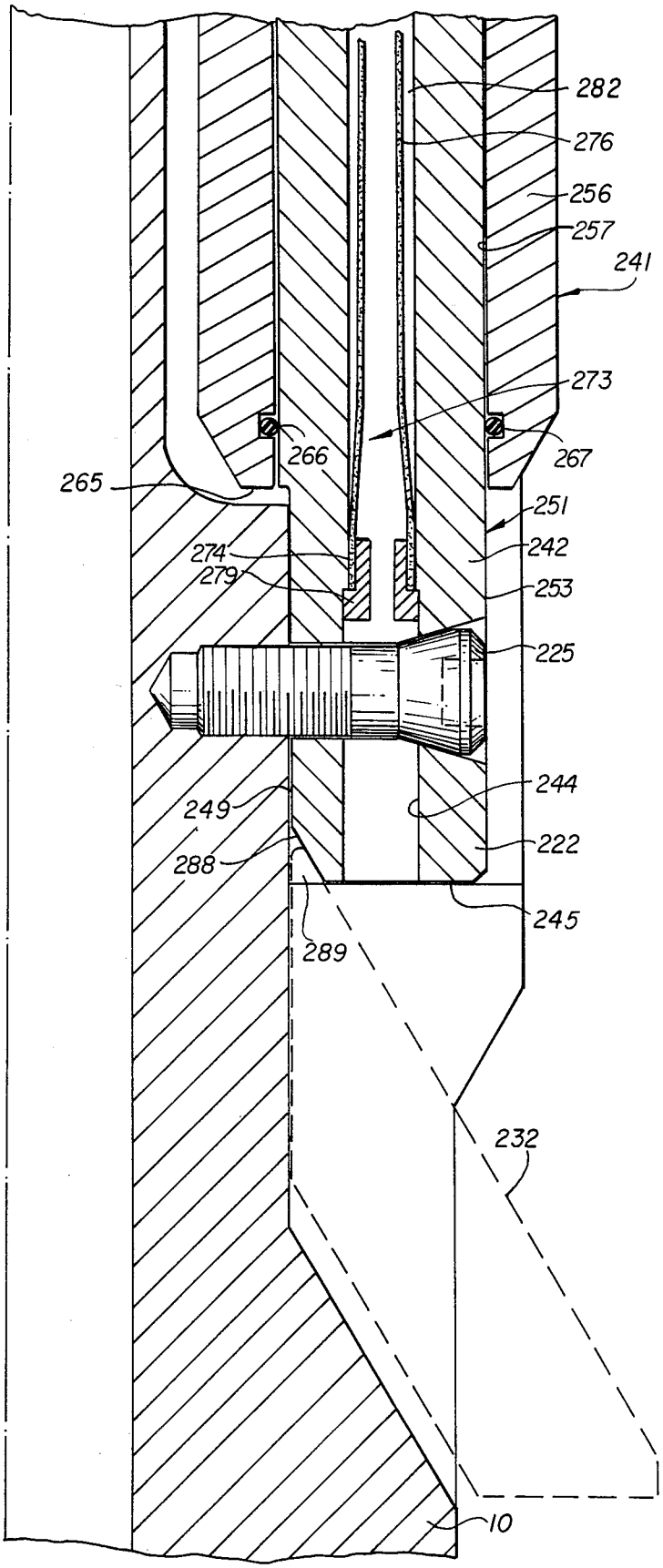
FIG. 41B
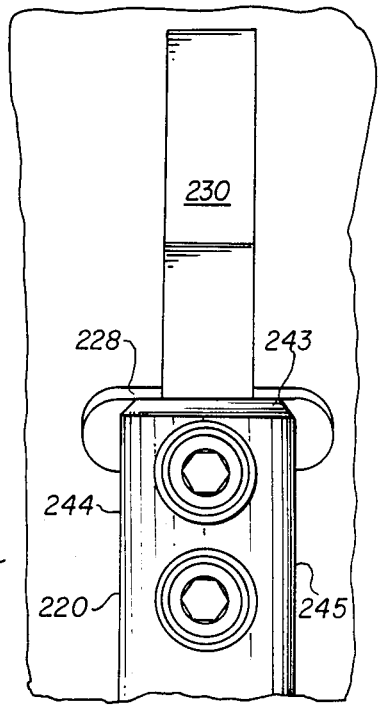
FIG. 42
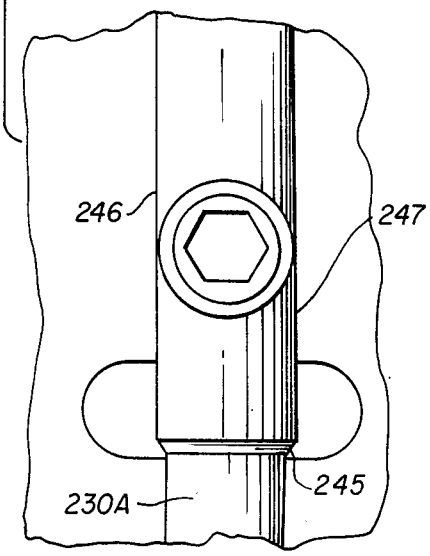

ROLLER-REAMER

This application is a continuation-in-part of copending application Ser. No. 174,515 entitled "Roller-Reamer", filed Aug. 1, 1980, now abandoned, and a continuation-in-part of copending application Ser. No. 246,210, entitled "Roller-Reamer", filed Mar. 21, 1983.

BACKGROUND OF THE INVENTION

1. Field of the Invention

This invention pertains to bore hole drilling apparatus and more specifically to that part of such apparatus known in the industry as a roller-reamer.

2. Description of the Prior Art

Roller-reamers have been employed in earth boring operations for the petroleum industry to provide two main functions. Depending upon the particular structure, these functions may be provided in a combination tool or the functions can be provided separately.

The first function that is provided by a roller-reamer is to cut formations to enlarge the hole to the desirable size, which may be the original size of the bit in the case where the bit wears to be under-gauged. However, even for new bits, roller-reamers are employed to cut formations because the bit does not always drill a true bore hole and because of slight lateral shifting which is inherent in the drilling operation, which shifting leaves ledges and other distortions.

The second function of a roller-reamer is to keep the drill stem in the center of the hole at the specific position of placement of the roller-reamer. In providing such a function, a reamer is often referred to as a "stabilizer". Maintaining the drill stem centered has many beneficial effects, its primary one being minimizing unintentional hole-angle directional drilling.

Generally speaking, a roller-reamer will always include the following parts: (1) Threaded connections at each end of the body for connection into the drill string at either end of the reamer. (2) Rollers and shafts (sometimes referred to as "cutters and pins") with axial and radial bearings. It should be noted that virtually all reamers have shafts extending through the rollers with the radial bearings being located between the two. In some instances, a trunnion design with a shaft integral with the roller and extending on each end of the roller is provided. In such case, the shafts rotate with the roller in sockets. (3) Fluid circulation passage through a hole in the center of the body.

Popular hole sizes for well bores range from 5" to 26" in diameter. Size of circulation passage through the center of the body of the reamer typically range from $1\frac{1}{2}$" to $3\frac{1}{4}$" in diameter. The body size on the necks beyond the area where the rollers are mounted typically range from $4\frac{1}{8}$" to 11" in diameter. This latter size will normally be the same size as the drill collar. Body links normally range from 4' to 8'.

Most roller-reamers have three rollers equally spaced in a single transverse section. Such roller-reamers are referred to as "3-point reamers". When two sets of three rollers spaced apart longitudinally are used, the roller-reamer is called a "6-point reamer". However, large diameter roller-reamers may have more than three rollers in one transverse section.

For purposes of discussion herein, a "roller-reamer unit" will refer to a single shaft, roller and related parts and "roller-reamer" will refer to the entire assembly of three or more roller-reamer units.

Bearing surfaces are normally case hardened, usually by the process of carborizing, quenching in oil from austinite at about 1500° F. When the roller or cutter is to be used for difficult reaming operations, the outer surface or cutting structure will have pressed fitted therein sintered tungsten carbide compacts for the cutting structure. However, when the roller is to be used mostly as a stabilizer, and only light reaming operations are to be encountered the outer surface may only be carborized and hardfaced with tungsten carbide particles.

In all events, most of the roller-reamer component parts are designed and manufactured to be replaceable so that as wear occurs, the worn parts are discarded and new parts are installed on the tool. It is desirable that the construction be such that the most expensive parts do not have to be replaced any more often than necessary. Also, it is desirable that the construction be such so as to minimize excessive wear from occurring in the first place under the environmental conditions of use. It should be remembered that a roller-reamer is subjected to extremely abusive conditions during its use by the very nature of such use. For example, this abuse results from twisting of the drill string and resistance thereto, longitudinal surges in handling the drill string and from the pressures of the formation and the fluids introduced for drilling purposes, from the variations in the lithological conditions encountered while drilling and in handling of the string for maintenance, repairs and non-drilling operations (e.g., removal for logging purposes, fishing purposes and the like).

It has been known that a condition imposed on the drill string known as "fretting" is one of the worse conditions that causes wear of the roller-reamer parts. Fretting is the small vibration act that constantly occurs in operation because of the many conditions imposed on the drill string during drilling. Fretting occurs in an up and down, back and forth motion and in a rotational motion all at once. To ensure minimum wear between adjoining parts, it is desirable to fixedly secure together as many parts as possible and to minimize the number of parts that have to move with respect to each other in the first place. In so doing, the places where fretting has an opportunity to occur is kept to a minimum. But, for places where it is not possible to fix one part to another, then it is desirable to have a bearing surface between such parts. Since some parts of a roller-reamer are rotational with respect to one another by their very nature, such parts cannot be fixed to each other. Other parts cannot be rigidly joined because they have to accept impacts beyond the flexure capability of the metal alone. Absence of such capability would cause premature damaging fatigue and fracture. Yet other parts cannot be permanently fixed or joined or eliminated in a simplified structure because they have to be non-destructively removable to facilitate replacement of worn parts.

It cannot be over-emphasized that roller-reamer assemblies are notoriously short-lived because of the extremely hard wear to which they are subjected, which wear is exerted on the assembly in all possible conceivable patterns and directions. As is explained hereinafter the embodiments of the present invention reduce the number of component parts compared with the prior art while maintaining tight fitting of those parts that do not have to have relative movement, providing bearing surfaces for those that do. In addition, by making some parts reversible, the effective life of many that do wear out is extended greatly. Furthermore, the embodiments presented herein also do not subject parts, other than the roller part itself, to gauge wear. That is, all other components are well within the outer limits of the outside diameter of the roller.

Perhaps the largest contribution of the present invention, therefore, is the virtual elimination of two types of wear occurring in prior art structures. Wear occurs during use in such structures (1) at the outside of the roller, (2) at the inside surface of the roller, (3) at the outside periphery of the shaft underneath the roller, (4) at the outside surface of the shaft inside the blocks, and (5) at the inside surface of the blocks. The latter two wear conditions are a result of fretting under dynamic loads. Fretting is almost totally eliminated in the embodiments of the present invention described hereinafter, and, hence, so are the types of wear that would normally accompany fretting.

The most relevant designs known prior to the present invention are shown and described in U.S. Pat. No. 4,182,425. These designs include a roller-reamer unit having a replaceable block structure for holding the shaft around which the cylindrical roller rotates (FIG. 1); a similar structure having a thrust bearing between the roller and the block (FIG. 1A); a similar structure wherein the shaft is welded to the block, the shaft also being flanged for accepting an axial thrust impact (FIG. 1B); and a similar structure wherein the upper block is welded to the shaft, there being a thrust flange or bearing and there being reservoirs for lubricating between sealed, relatively rotational components of the structure (FIGS. 9, 9A, 9B, 9C and 9X). The other structures of '425 related to roller-reamers having air bearings and are not relevant to the present invention.

The blocks used in the embodiments disclosed in '425 are expendable components which wear with use because of fretting and otherwise. Although such blocks facilitate replacement, having to throw away previously used blocks contributes substantially to the cost of using a roller-reamer. In the roller-reamers employing a sealed bearing construction, the top block is expended each time a roller and shaft is worn out because the block is welded to the shaft.

Also, in the sealed bearing roller-to-shaft construction of the '425 patent, the lower block must protrude beyond the body diameter in order to protect the lower seal between the roller and shaft in a heavy reaming operation. Especially in such an embodiment but in the case of all of the lower blocks employed in the embodiments shown in the '425 patent, the outer surface of such blocks are subjected to wear during the reaming operation. Such wear is a result of fretting at the shaft contact and at the points of wear engagement of the outer surface with the borehole.

Experience has shown that with all of the non-sealed constructions of patent '425, both top and bottom blocks must be replaced by the time two or three sets of rollers and their shafts are worn out as a result of the types of wear mentioned above and because of wear resulting from the thrust of the reamer in action.

The prior art also reveals a system for tightening the shaft of a roller-reamer unit into the body in such a manner to presumably tightly hold it, but this technique critically fails to cause uniform securing and therefore invites non-uniform wear and fretting after short periods of use. In this system, the end of the shaft is split. A block having a transverse tapered pin is forced over the shaft end, the pin acting within the slot to force the end of the shaft apart against the inside surface of the block. The block is then welded in place. The tapered pin successfully tightens the end of the shaft against the block at the two points normal to the axis of the pin. But, the pin does not successfully tighten the shaft end at locations remote from these two points, thereby inviting wobble and uneven wear. Further, welding the block means it must be destroyed each time the shaft is replaced.

Therefore, it is a feature of the present invention to provide an improved roller-reamer apparatus wherein each replaceable roller-reamer unit employs either no blocks or few block parts, and wherein the unit is otherwise completely tightly fitted within the body of the roller-reamer and the moving parts are protected with radial and thrust bearings.

It is another feature of the present invention to provide an improved roller-reamer unit wherein the shaft is replaceable but tightly fitting with the body, thereby eliminating wear attendant to fretting.

It is still another feature of the present invention to provide an improved roller-reamer unit having releasable shaft blocks, the shaft tightly fitting with the blocks and the blocks within the body, thereby achieving wear-elimination of the blocks because of fretting.

It is yet another feature of the present invention to provide an improved roller-reamer unit having a block that does not radially protrude beyond the limits of the roller portion.

It is still another feature of the present invention to provide an improved roller-reamer unit with an internal lubrication reservoir, the lubrication being provided between the shaft and the reamer, the lubricated portion being sealed substantially at both the upper and lower ends of the roller.

It is yet another feature of the present invention to provide an improved roller-reamer unit having roller bore hole contacts below the lower lubricating seal to provide protection therefor.

It is still another feature of the present invention to provide an improved roller-reamer unit shaft that is 180 radial degrees reversible for extending the effective useful life of such shaft.

SUMMARY OF THE INVENTION

The embodiments of the roller-reamer inventions herein disclosed each include means for tightly securing the shaft of a roller-reamer unit to the body of the roller-reamer. In one embodiment a reduced end portion of the shaft is forced by interference fit into a shaft slot and secured by a cap screw to assure firmly seating the shaft to the body within the confines of the shaft slot. Another embodiment secures the end using a safety plug held in place by cap screws, which, in turn, secures against the shaft end inadvertently coming loose. Other embodiments employ blocks that are secured rigidly in place by screws or wedge fitting and which, in turn, tightly hold the shaft end by a flexed open slot or a tapered wedging action or both provided via a block. The block is protected from being dislodged by a plug, a nut-and-bolt arrangement, an auxiliary U-wedge fitting around the block, or the like in various exemplary embodiments. In each case, the ends are secured in such a manner that no structure utilized in tightly connecting the shaft to the body extends beyond the limits of the cutter or employs welding or other non-releasable connecting means.

One embodiment of a shaft and roller combination employs an internal lubricating reservoir pressurized to emit lubricant between the shaft and roller, the lubricated area being sealed and the lower seal being protected by a reaming element on the surface of the roller rather than by a block protruding surface therebelow, as with the prior art.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiments thereof which are illustrated in the appended drawings, which drawings form a part of this specification. It is to be noted, however, that the appended drawings illustrate only preferred embodiments of the invention and are therefore not to be considered limiting of its scope, for the invention may admit to other equally effective embodiments.

In the Drawings:

FIG. 9 is a partial longitudinal cross-sectional view of an alternate embodiment of a roller-reamer unit employed in a roller-reamer in accordance with the present invention.

FIG. 10 is a partial transverse cross-sectional view taken at line 10—10 of FIG. 9.

FIG. 11 is a partial transverse cross-sectional view taken at line 11—11 of FIG. 9.

FIGS. 12, 13 and 14 are the top, side and end views, respectively, of a shaft seat employed in the embodiment of the invention shown in FIG. 9.

FIG. 18 is a partial longitudinal cross-sectional view of yet another alternative embodiment of a roller-reamer unit employed in a roller-reamer in accordance with the present invention.

FIG. 19 is a partial longitudinal cross-sectional view of the embodiment shown in FIG. 18 showing the block portion partly assembled.

FIGS. 20, 21, 22, 23 and 24 are transverse cross-sectional views taken respectively at lines 20—20, 21—21, 22—22, 23—23 and 24—24.

FIG. 25 is a partial longitudinal cross-sectional view of the block slot employed in the embodiment of the invention shown in FIG. 18.

FIG. 26 is a partial longitudinal cross-sectional view of the block employed in the embodiment of the invention shown in FIG. 18.

FIG. 27 is a side view of the block shown in FIG. 26.

FIG. 28 is a partial longitudinal cross-sectional view of still another alternative embodiment of a roller-reamer unit employed in a roller-reamer in accordance with the present invention.

FIG. 29 is a transverse cross-sectional view taken at line 29—29 of FIG. 28.

FIG. 30 is a longitudinal cross-sectional view taken at line 30—30 of FIG. 28.

FIG. 31 is a partial longitudinal cross-sectional view of yet another alternative embodiment of a roller-reamer unit employed in a roller-reamer in accordance with the present invention.

FIGS. 32, 33, 34 and 35 are cross-sectional views taken respectively at lines 32—32, 33—33, 34—34 and 35—35 of FIG. 31.

FIGS. 41A and 41B in composite are a longitudinal cross-sectional view of an improved roller-reamer unit employed in a roller-reamer in accordance with this invention.

FIG. 42 is in composite a top fragmentary view of FIGS. 41A and 41B showing the details of the shaft ends.

DESCRIPTION OF THE PREFERRED EMBODIMENTS

Figure 1:
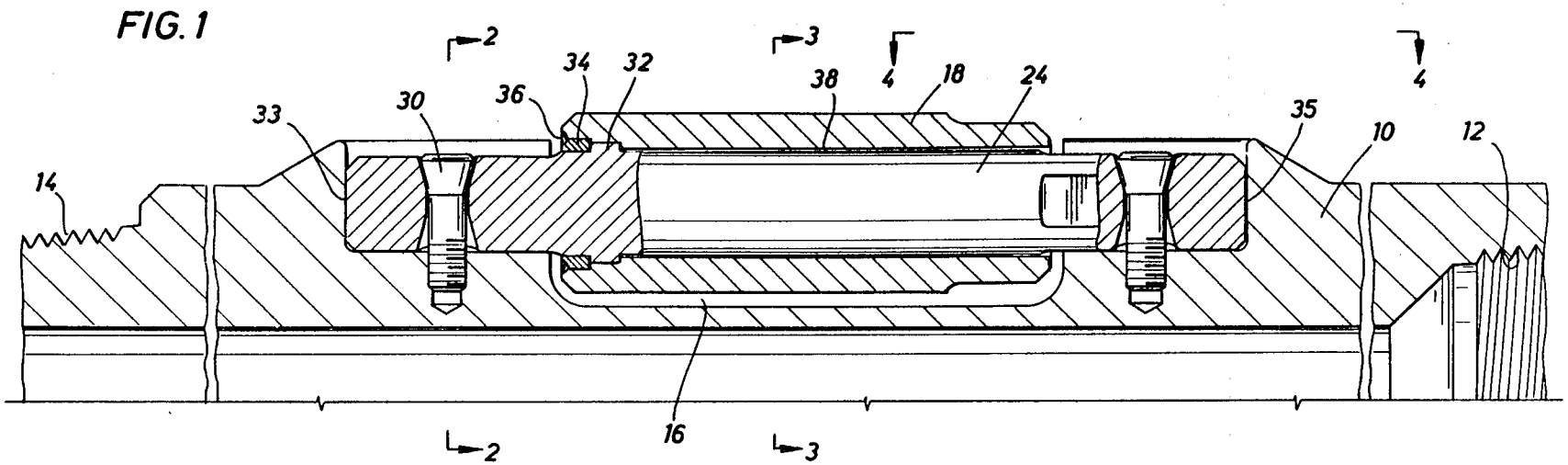
FIG. 1 is a longitudinal cross-sectional view of a roller-reamer unit employed in a roller-reamer in accordance with the present invention.

Now referring to the drawings, and first to FIG. 1, a roller-reamer unit in accordance with the present embodiment is shown in longitudinal cross section. It is usual that such units are deployed about body 10 of the roller-reamer so that there are three such units in each roller-reamer or so that there are multiple groups of three such units.

At either end of body 10, the roller-reamer is threaded at threads 12 and 14 for suitable connection to adjoining members cooperatively threaded therewith in the drill string. The body of the roller-reamer includes a fluid circulation hold therethrough and is normally located not too far above the drill bit. It should be noted that threads 12 are located within the box section and threads 14 are located within the pin section. For purposes of discussion, the pin section is considered to be at the top end of the roller-reamer assembly and the box section is considered to be at the lower end.

The body includes an outwardly opening elongated slot pocket 16 for receiving the elongated roller 18 therein. The roller is somewhat less elongated that the pocket, as well as being dimensionally less in diameter, so that fluid in the bore hole which is present for drilling purposes circulates around the periphery of the roller as well as between each of adjacent rollers in the annulus formed by the hole bore and reamer body outer diameter.

It may be further noted that the openings around the roller are slightly rounded at their outer periphery at corners 20 and 22 to minimize the possibility of improvident lodging of foreign matter.

Roller 18 is generally cylindrical in shape and is mounted on a shaft 24, the shaft and roller being concentrically positioned on a common axis. The shaft extends beyond the limits of the roller for mounting purposes within an accommodating shaft end slot 26. Slots 16 and 26 are contiguous; however, slot 26 is reduced in size to accommodate and conform to the shaft end in the manner hereafter described.

Figure 2:
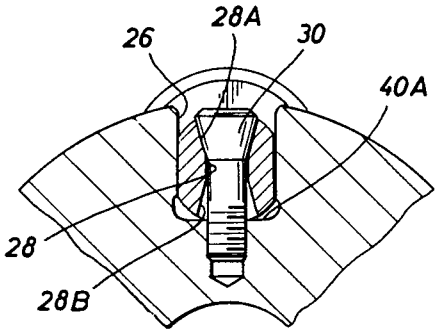
FIG. 2 is a transverse cross-sectional view taken at line 2—2 of FIG. 1.

As may be best shown in FIG. 2, the surfaces of the shaft and the adjoining contiguous surfaces of slot 26 are flat so as to keep the shaft from turning and for providing an increased pressure area for better containment of shaft to body. It should also be noted that the shaft ends are each bored with an opening 28, which is generally on a radial axis. Bore 28 gradually outwardly flares to the outside at flare 28A and to the inside at flare 28B and is sized for accommodating as a seat a safety cap screw. The body is bored and tapped in alignment with bore 28 for receiving cap screw 30. Bore 28 is flared out in the opposite directions in a symmetrical manner so that when the shaft is rotated 180°, cap screw 30 is equally accommodated.

In assembly of the shaft within the shaft slots, the shaft is pressed into place in the shaft slots at either end so as to form abutments 33 and 35 for high-thrust loads. There is an interference fit not only at both ends, but also along either side of shaft slot 26. That is, the flat surfaces on the shaft are slightly further apart than the width of slot 26 in the body and the parts are held in position relative to one another by slight metallic elastic deformation.

The cap screw is tightened in place in conventional manner; however, it should be noted that its head in its tightened position is still within the confines of the shaft slot and does not radially extend outwardly pass the surface of the roller into the bore. Of course, the shaft end is even further within the shaft slot.

Returning to FIG. 1, note that shaft 24 includes an enlargement or flange 32 for carrying thrust loading with respect to a thrust bearing ring 34 above the thrust flange. That is, the radial surfaces of the flange contact and carry some of the longitudinal load when there is a dynamic thrust force encountered during operation. Ring 34 is secured at the upper end of roller 18 by welds 36, ring 34 being located between the roller and shaft. Thrust bearing rings around the shaft between each end of the roller and the body could be equally effective. Radial bearing 38 is provided between the internal surface of the roller and the outside surface of the shaft within the roller.

Figure 4:
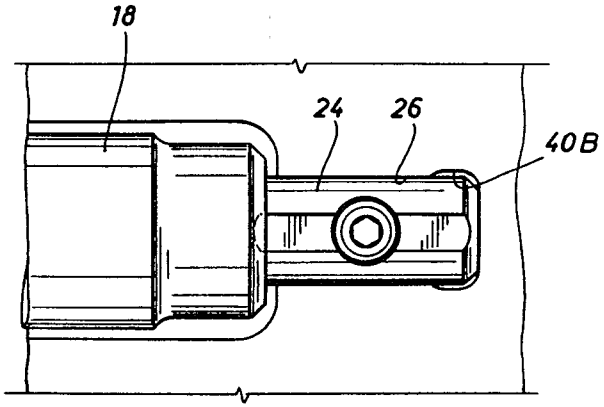
FIG. 4 is a top fragmentary view of FIG. 1 showing the details of the shaft end.
Figure 3:
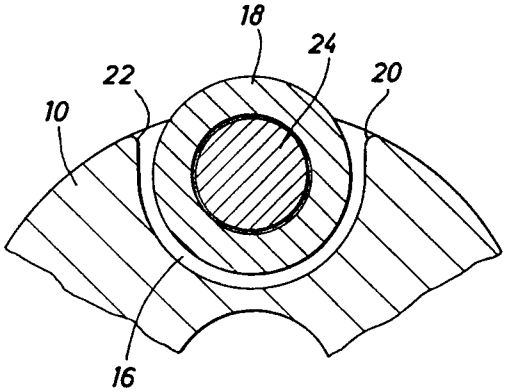
FIG. 3 is a transverse cross-sectional view taken at line 3—3 of FIG. 1.

As described above, it has been pointed out that there are two places where thrust loads are carried, at the roller thrust bearing and at the body-to-shaft abutments. Now referring to FIG. 4, it may be observed that the slot in which the shaft is located is slightly enlarged at the tip of the shaft. Very heavy thrusts will cause both the shaft and the body to slightly elastically deform. If the shaft was held in a tight manner at every bit of surface area, the tip of the shaft might well receive such squeezing or pressure that it would cause metal failure at that point. Slot enlargement 40A and 40B, which is somewhat inherent in the manufacture of the slot, provides relief from the creation of such destructive pressure.

In removing the shaft for replacement purposes, the cap screws are first removed and then an expandable puller tool is inserted through the cap screw bore 28 into the tapered back portion 28A of bore 28, allowing the tool to expand for pulling purposes. If the shaft is still unworn on one side, then it is rotationally reversed 180° and reinserted, as before.

Figure 5:
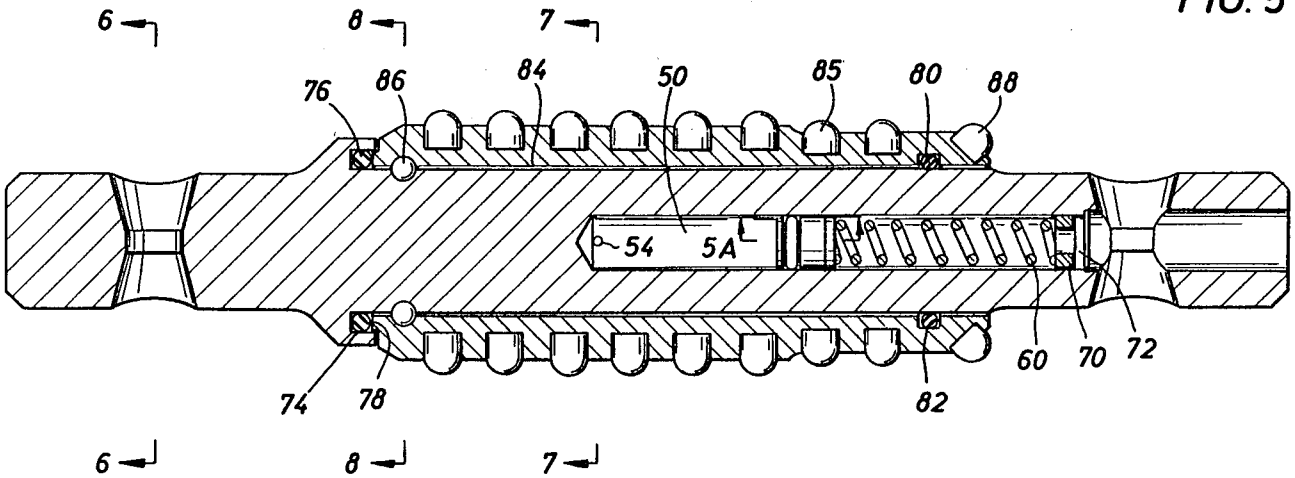
FIG. 5 is a longitudinal cross-sectional view of a self-lubricating roller-reamer unit subassembly for a roller-reamer in accordance with the present invention, FIG. 5A a part of the reservoir assembly.

Now referring to FIG. 5, an embodiment of a roller-reamer unit is shown which includes a self-contained lubricating means for lubricating the surfaces between the shaft and the roller.

At the upper end of the entire assembly, the shaft is formed in such a manner so as to create skirted slots 74 for receiving O-rings 76. An upward projection 78 from the roller presses against the O-ring, thereby establishing an effective seal at the upper end of the roller. At the lower end of the roller, O-rings 80 acting within an accommodating slot 82 forms an effective seal with respect to the shaft and the roller. Radial bearings 84 and thrust ball bearings 86 are provided between the shaft and the roller within the area between seals 76 and 80. It should be noted that the cutting surface of the roller is provided by carbide compacts 85 pressed into place. One such cutter row 88 is located in a lower depending skirt portion on the roller which depends below seals 80. Such a location for this cutter row provides protection against foreign matter working its way between the shaft and the roller at this location. Note that the shaft does not have to be enlarged and blocks do not have to be provided for the shaft to protect such seal as with many prior art structures.

Figure 8:
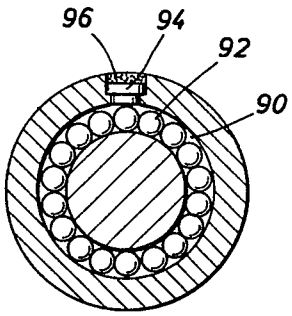
FIG. 8 is a partial transverse cross-sectional view taken at line 8—8 of FIG. 5.
Figure 5A:
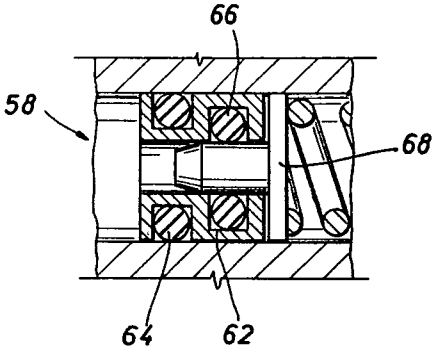
Figure 7:
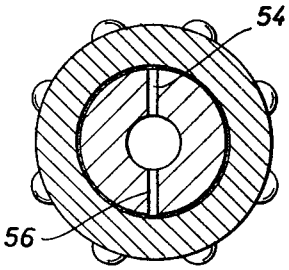
FIG. 7 is a transverse cross-sectional view taken at line 7—7 of FIG. 5.
Figure 6:
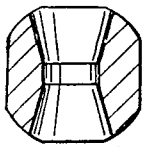
FIG. 6 is a transverse cross-sectional view taken at line 6—6 of FIG. 5.

The thrust bearing can readily be provided as shown in FIG. 8. A trace 90 is provided in both the shaft and the internal roller surface, as shown. A radial hole is provided through the roller through which balls 92 can be inserted for filling the trace. After the trace is full, plug 94 is used to fill the hole, on top of which weld 96 is provided to seal off the plug and to insure that no foreign matter enters the trace through the previous radial opening through the roller.

The entire roller-reamer unit which has been described in connection with FIGS. 5–8 is mounted within the roller-reamer in the same manner as the unit or assembly illustrated in FIGS. 1–4.

Reservoir 50 is provided along the axis of the shaft internal thereto and extending from side opening into cap screw bore 52. Lubrication or grease ports 54 and 56 are provided at the internal end of the reservoir and extend to the outside surface of the shaft underneath the roller at about the mid-point of the roller.

Pressure is put on the lubricant within the reservoir by way of a spring and piston arrangement comprising at one end an O-ring seal assembly 58 explained more fully hereafter but which is pressed toward the grease ports via helical coil spring 60.

The reservoir operation can be more fully understood in relation to its loading.

The lubricating reservoir is filled in the following manner. First, the shaft, roller-reamer, seals and ball thrust bearings are assembled. Then the reservoir and the bearings are all subjected to a vacuum while grease is forced into the bearings and reservoir under atmospheric pressure.

S-shaped seal holder 62 with seals 64 and 66 held therein is then longitudinally forced through the reservoir into its proper position. Excess grease is allowed to flow through its axially central opening as it is pushed forward. Seal 64, held by seal holder 62, operates in contact with the walls of the reservoir. Inward acting seals 66 then seals off the reservoir and bearings with the insertion of plug 68 in the center opening.

Next, helical coil spring 60 is inserted to cause a slight pressure on the grease in the reservoir. Then ring 70 is pressed into bore 72 with a tight fit to its proper position to compress spring 60 for the correct pressure in the reservoir.

It is important that the pressure on the inside of the lubricant reservoir be only slightly higher than the outside. It should be sufficient to urge the clean lubricant under the seal and prevent intrusion of the drilling fluid. It should not be so high that excess pressure and friction would cause short seal life.

In operation, as lubricant escapes during use, the volume compensator comprising the piston and spring just described will squeeze out additional lubricant or grease through ports or passages 54 and 56 to the bearings.

Of course, the bladder structure reservoir shown in FIGS. 9 and 9A of U.S. Pat. No. 4,182,425 could be employed in place of the reservoir structure just described, if desired.

Now turning to FIG. 9, an embodiment of the invention is shown wherein the end of the shaft 100 is shown secured within accommodating shaft slot 102 by interference fit as before. But instead of the shaft being secured to the body through the shaft slot by way of a cap screw, a safety plug 104 is employed. The end of shaft 100 is longitudinally bored with an enlarged hole 106 along its axis for receipt of an inward projection 108 form plug 104. Plug 104 is held in place to the body by way of cap screws 110 and 112, the body being bored and tapped in alignment with the accommodating bore holes in plug 104.

Located behind the end of shaft 100 is a shaft seat 114, as best shown in FIGS. 12–14. The shaft seat is contoured to accommodate the curvilinear surface of the end of shaft 100 and includes notches for partly surrounding the cap screws when they are in place and to hold the seat in proper location. The shaft seat allows a certain amount of sizing of the hole to be reamed by the roller-reamer. A very thin shaft seat would mean that the roller-reamer would cut a relatively small diameter hole and a large thickness shaft seat would mean that the diameter of the reamed bore would be somewhat larger.

Countersunk holes for the heads of cap screws 110 are threaded with threads 104A to receive a puller tool for removal of shaft, roller and plug.

Figure 15:
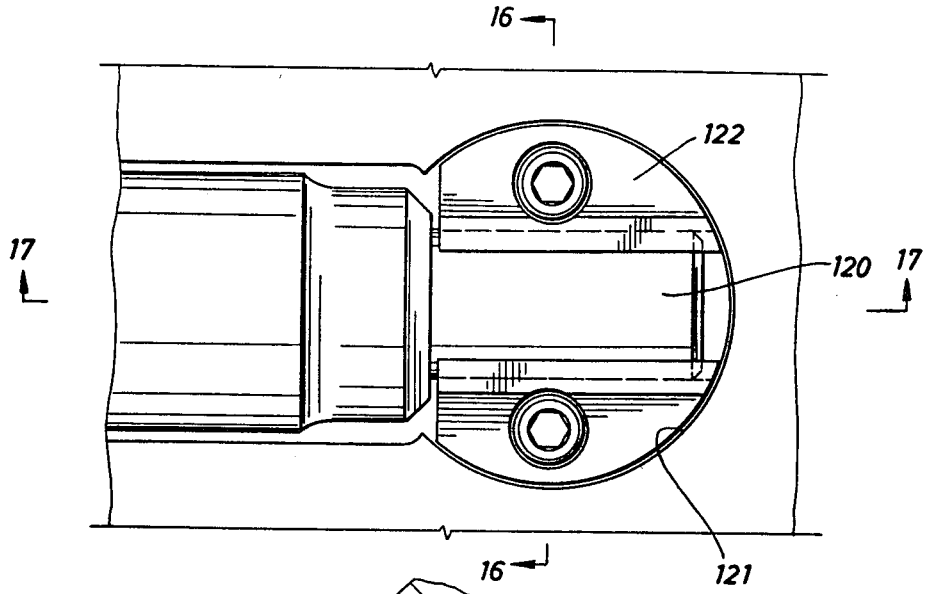
FIG. 15 is a partial longitudinal cross-sectional view of another alternate embodiment of a roller-reamer unit employed in a roller-reamer in accordance with the present invention.
Figure 16:
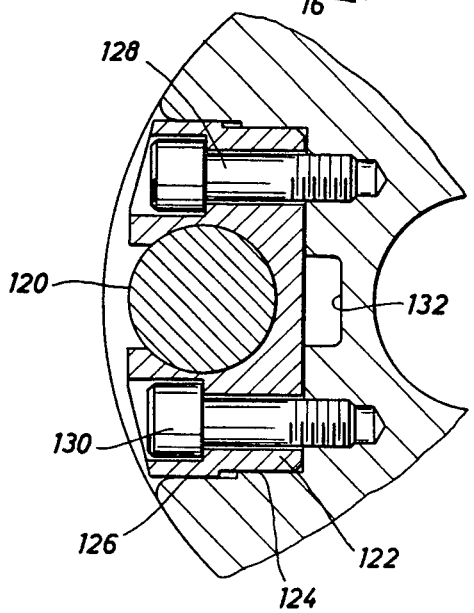
FIG. 16 is a partial transverse cross-sectional view of the embodiment shown in FIG. 15 taken at line 16—16.

Now referring to FIG. 15, a connector arrangement for securing shaft 120 in position is shown. In this embodiment, pocket 121 which is contiguous with the main pocket surrounding the roller is suitable for accepting block 122. Block 122 is stepped on its sides at flats 124 and 126 for being pressed within its slots by an interference fit. The longitudinal opening through the block for accommodating the end of the shaft is opened on the external side for permitting flexure of the block about the shaft end.

In mounting the shaft, the block is put in position about the end, the shaft and block are inserted into the accommodating block slot with an interference fit obtaining at cylindrical segment 124 and 126. At this time, the shaft can be tight or a little loose within block 122. Insertion of block 122 into opening 121 causes the open slot through the block to be squeezed about the shaft end. Cap screws 128 and 130 are then tightened into position through bore holes in block 122 into aligned bored and tapped holes in the body.

Figure 17:
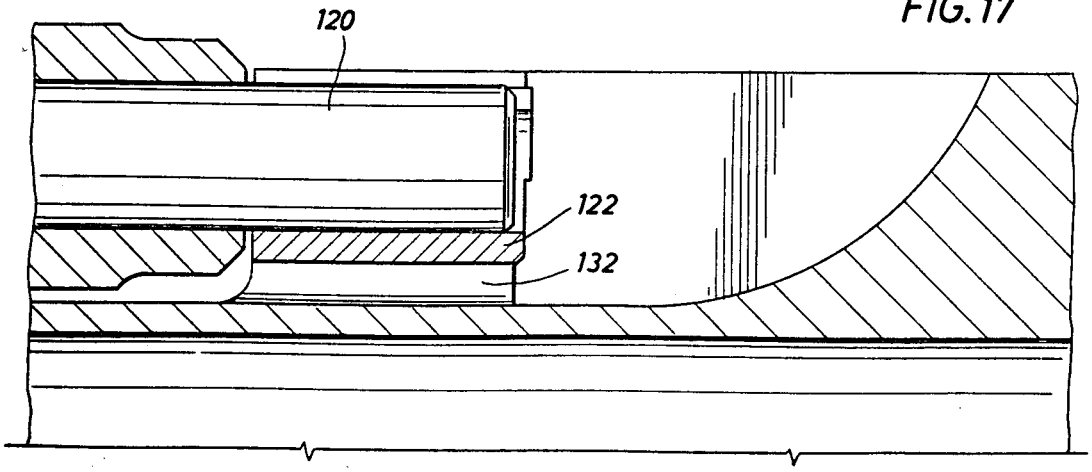
FIG. 17 is a partial longitudinal cross-sectional view taken at line 17—17 of FIG. 15.

There is a elongate removal slot 132 located behind block 120 which extends past the longitudinal end of the shaft, as best seen in FIG. 17. A removal tool may be placed in slot 132 for removal of block 120 in a manner similar to that shown in FIG. 9C of U.S. Pat. No. 4,182,425.

Now referring to FIG. 18, a roller-reamer unit attachment is shown, wherein the end of the shaft is tapered at end 140. The block pocket through which the shaft end extends includes block hold down tangs 142 deeply within the slot and running longitudinally therewith. As is shown in FIGS. 20–22, block 144, which fits over the end of the shaft, is grooved for mating with tangs 142. The block includes a longitudinal opening hole which is tapered to receive the shaft and which opening is open on one side to permit squeezing flexure of the block about the shaft for tight fitting. As may be seen by FIG. 19, the block slot is contiguous with a safety plug slot therebelow for permitting insertion of the block after the roller end is in approximate position. The block is then pressed over the shaft end with the accommodating grooves of block 144 in position over tangs 142, as shown. There are crosswise impact surfaces 146 on the outside surfaces of block 144 to permit a tool to be used for driving the block onto the end of the shaft. These surfaces are approximately normal to the axis of the shaft. As the block is moved toward the center of the shaft on its end, the flexure of the opening in the block tightly squeezes the end of the shaft. The taper causes the block to become tight in the body slot.

Once the block is in position, as shown in FIG. 18, a safety plug having an opening slotted to its inside, is positioned over the shaft end and then the plug is secured, as with the other embodiments by a cap screw 150, through a bore in the safety plug and into an aligned bore and tapped screw hole in the body aligned with the cap screw bore in the block.

Now turning to FIG. 28, a tapered end 160 of the shaft is shown secured by a block 162 having outwardly turned lips 164 deeply within the accommodating block slot and a U-shaped wedge member 166 about the block. The slot has inturned lips 168 near the opening of the slot and aligned opposite lip 164, as best shown in FIG. 29. The U-shaped wedge member includes two prongs 170 and 172 for positioning about block 162 and wedging forward by a tool placed within the block slot and axially forcing the wedge member, and hence the block, toward the main body of the shaft. Prongs 170 and 172 are each wedge-shaped so that as the wedge-shaped member is forced forward, the block is tightened in position. The base of the U-shaped member never comes in contact with the end of the shaft since there is an ample opening 174 therein.

After the connection is completely made, a safety plug 176 is placed within the block slot so as to bear upon the base of the U-shaped member. Cap screws 177 are used to hold safety plug 176 in place, as with the previous embodiments.

Now turning to FIG. 31, a straight shaft 180 is positioned within a block slot which is tapered so that its narrowest diameter is at the point where it is contiguous with the roller or main slot.

Figure 32:
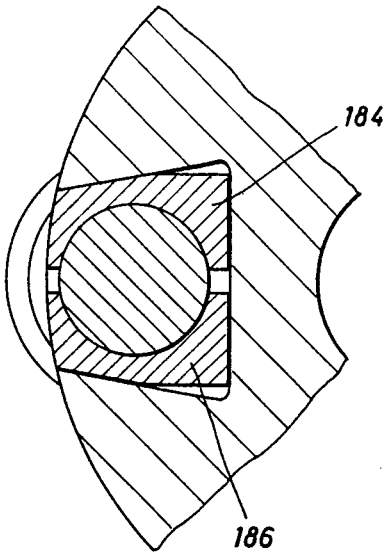

Block 182 includes external surfaces which are contiguous with the internal tapered surfaces of slot 181 just described. Block 182 also includes a longitudinal slot on two sides so that the block generally divides into two sections 184 and 186 for encompassing the shaft end. As the block is driven onto the shaft end the flexure provided by the two openings or slots in the block provide squeezing of the shaft end by the block. FIG. 32 provides a view of how this squeezing occurs.

Figure 33:
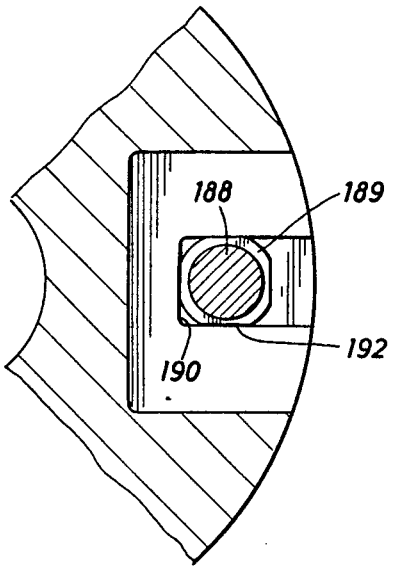
Figure 34:
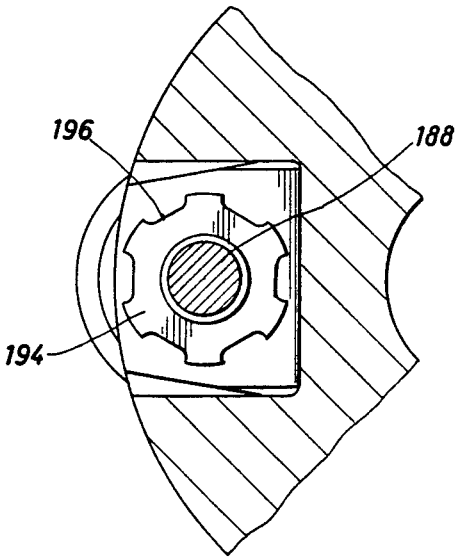
Figure 36:
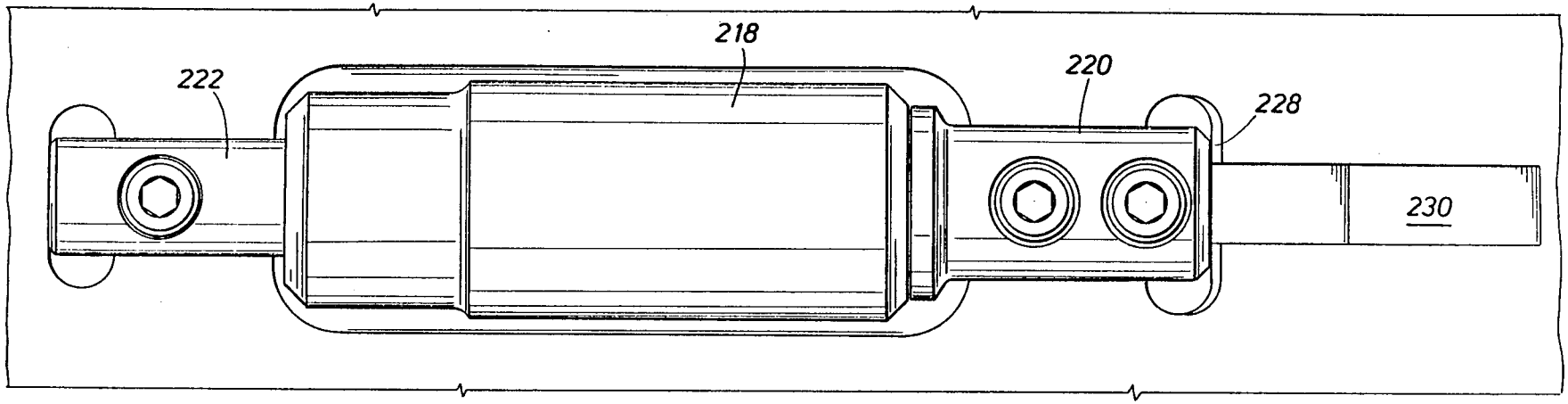
FIG. 36 is a partial top view looking down into a pocket of an alternate embodiment of a sealed-bearing reamer in accordance with the present invention and showing the roller-reamer unit.

The block is held tightly in place onto the shaft by a bolt and screw arrangement. Bolt 188 is axially elongate with the shaft end so that head 189 thereof, having flats thereon, is held in position on a shelf 190 and in an accommodating slot therefor with appropriate flats 192, as shown in FIG. 33. The screw shaft is threaded on its opposite end to accommodate a nut 194, which is screwed thereover. The nut is fluted on its outer surfaces at 196 to permit a tool for sideways driving to cause the nut to axially progress toward the end of the shaft to tighten and hold block 182 in place. It should be noted that an auxiliary tool may be used to hold head 189 of screw 188, rather than having it self-held; however, the self-held screw and bolt arrangement simplifies the tightening of the bolt with respect to the shaft of the screw.

Now referring to the embodiment of the invention shown in FIGS. 36–40, this embodiment is similar to the embodiment disclosed in FIG. 5 above. Therefore, with the exceptions of the differences hereafter described, it should be considered substantially indentical to such embodiment.

Roller-reamer 218 includes a pin end 220 which is wider than corresponding shaft end 222 at the opposite end of the unit to probide greater strength thereat. Each of these shaft ends are located within respectively accommodating slots in the manner for the other embodiments described above.

It is assumed that pin end 220 is toward the top of the roller-reamer apparatus when such apparatus is in use and that end 222 will be toward the bottom. In addition, pin end 220 includes two respectively aligned bored openings radial to the axis for receipt of cap screws 224 and 226, rather than a single bore and cap screw as with end 222.

In this embodiment, pin 220 is not made reversible, which permits the pin to be made stronger at the ends. Shoulder 228 abuts the end of pin 220 at this location.

Elongate removal slot 230 extends longitudinally above and from the slot accommodating shaft end 220 to permit removal with a drive out or removal tool 232 shown in dotted section. The tip end of shaft 220 is slightly tapered to permit the tool to be placed therebeneath. When the tool is used to pry up the pin end for removal purposes, the unit rotates about a point at the upper corner of the bottom shaft and additional clearance is made possible for continued rotation upward as soon as the abutting pin surface clears shoulder 228.

The lubrication and bearing systems which are illustrated are not described here in detail since they are substantially the same as for the embodiment shown and described for FIG. 5.

Figure 37:
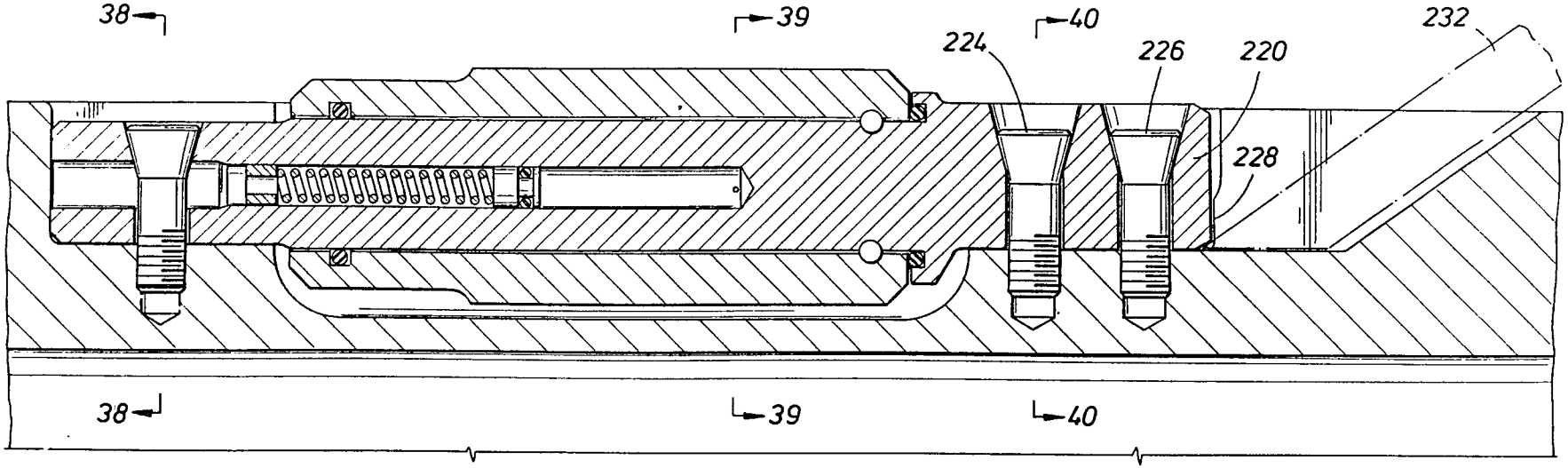
FIG. 37 is a longitudinal cross-sectional view of the roller-reamer unit employed in the reamer shown in FIG. 36.
Figure 38:
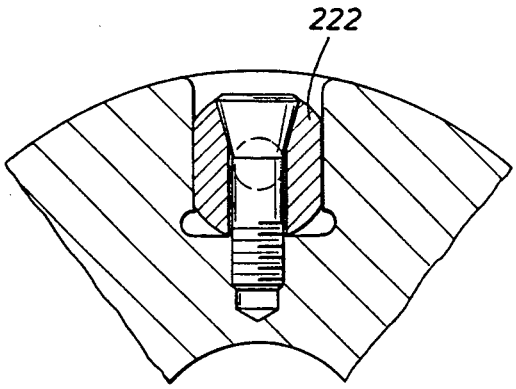
FIGS. 38, 39 and 40 are the respective cross-sectional views taken at lines 38—38, 39—39 and 40—40, respectively, shown in FIG. 37.
Figure 39:
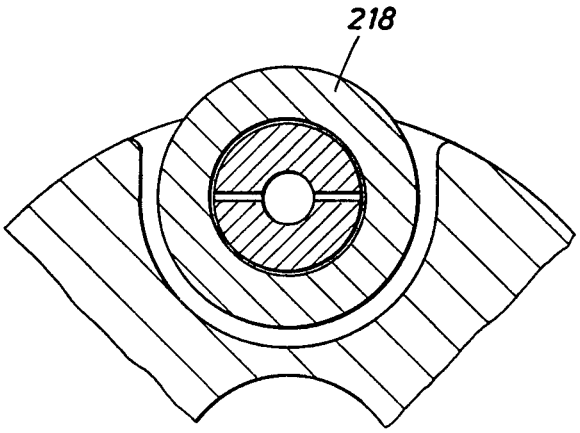
Figure 40:
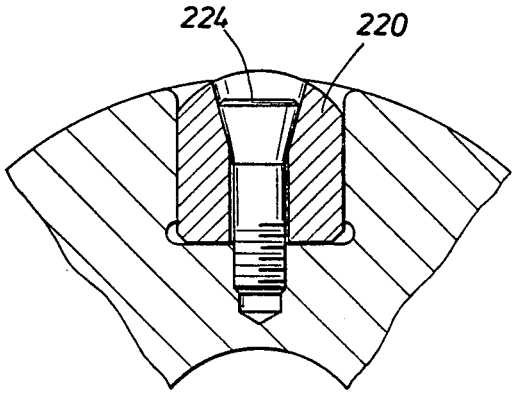

The reamer shown in FIG. 37, or for that matter, a reamer without a self-lubricating system, could also be constructed for carrying a thrust load in similar fashion to the FIG. 1 embodiment, if desired. That is, the top end of the reamer shaft, would include an enlargement or flange for carrying thrust loading with respect to a thrust bearing ring above the flange and with respect to the roller below the flange. The ring would have to be in separate sections if the shaft end is too large in any dimension to allow it to fit over the end to its position of use. The ring would then be secured at the upper end of the roller by welding, the ring being located between the roller and the shaft.

Figure 41A:
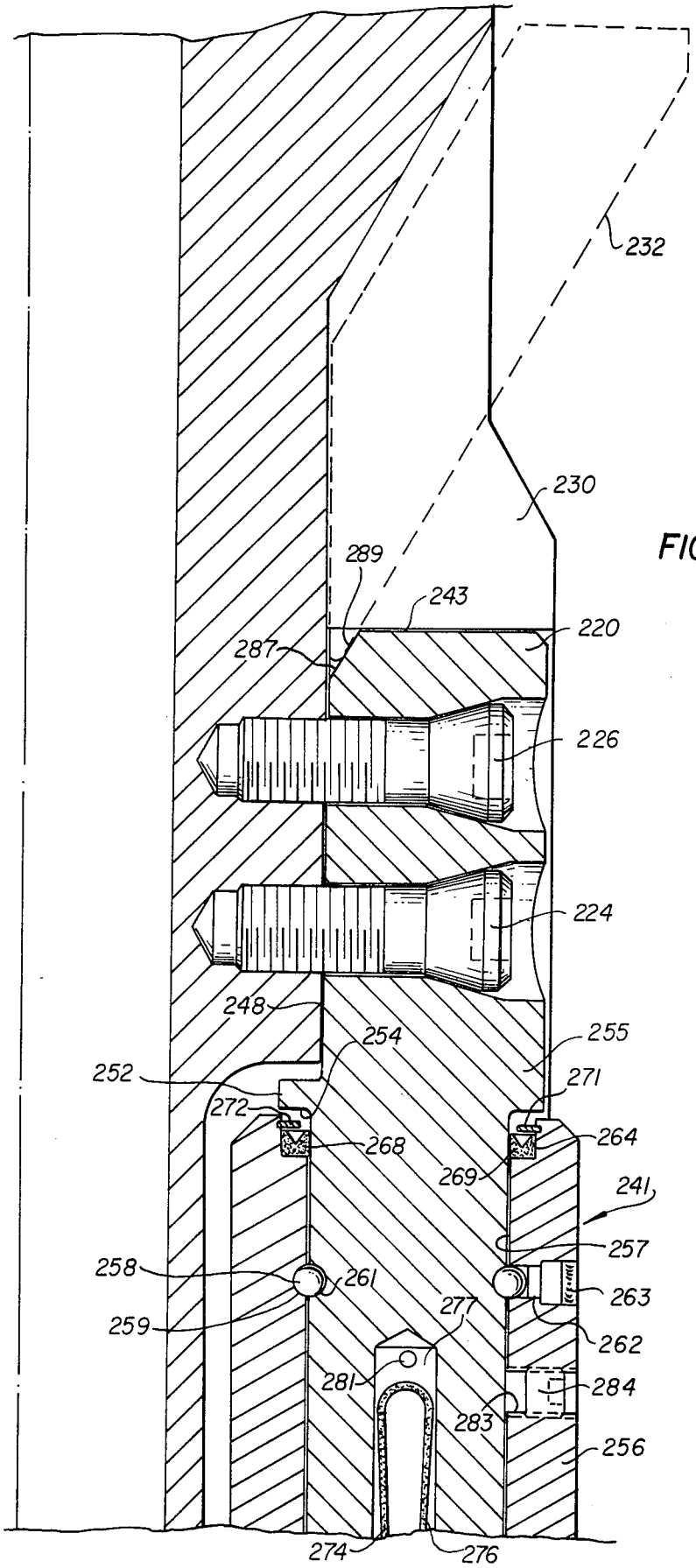

Referring to FIGS. 41A and 41B, and 42, there is shown an improved subcombination of roller and shaft, which combination can be plant assembled and lubricated as a unit. Then, the unit can be utilized in plant assembly of the roller-reamer unit or transported as spare parts for the field replacement upon roller-reamer units which develop defective roller or shaft components.

One important advantage of this roller and shaft combination is that its assembly and lubrication can be in a clean environment, such as the manufacturing plant rather than in the dirty surroundings on a rig floor.

This improved subcombination 241 closely resembles the roller and shaft arrangement illustrated in FIGS. 36–40. In this regard, like elements of the structure in FIGS. 36–40 will be given like reference numerals relative to FIGS. 41A and 41B and FIG. 42, and these like elements have equivalent functions in the subcombination 241.

The subcombination 241 is received in the recess formed in the body 10 and has the shaft 242 provided with a pin end 220 wider than the other pin end 222. The shaft 242 has flat ends 243 and 245 which are perpendicular to the longitudinal axis of the shaft. The pin ends carry flat parallel side surfaces 244–247 and flat bottom surfaces 248–249, which bottom surfaces are perpendicular to the side surfaces.

The shaft 242 is received in accommodating slots with the side surfaces at interference fit with elastic deformation of the surfaces. Naturally, the shaft must be driven into the body to form the interference fit between the side surfaces and the accommodating slots. The flat ends 243 and 245 have slight clearance with the shoulders 228 to each side of the elongated removal cuts or slots 230 and 230A. The cap screws 224–226 secure the shaft within the slots with compression loading between the bottom surface 248–249 and the body 10.

The shaft 242 has a uniform diameter portion 251 extending from the pin end 222 to a radial projection 252 residing adjacent to the pin end 220. The pin end 222 is arranged with the flat sides and bottom side, and a like circular top surface 253 so that the maximum transverse dimension is not greater than the diameter of the portion 251 of the shaft. For this purpose, the corner of the pin end 222 can be rounded. The radial projection 252 has an exterior surface 255 which can be of the same dimension as the pin end 220. Also, a flat abutment face 254 is provided on the projection 252 which protects the seal 268 and the clip 271 on the roller from physical damage.

The roller 256 has a cylindrical exterior surface and cylindrical center bore 257 with a diameter sufficient just to pass slideably over the pin end 222 and be journaled upon the uniform portion 251 of the shaft 242. As a result, a radial bearing is provided by the portion 251 lengthwise within the center bore 257 of the roller.

A thrust bearing mounting is provided by bearing balls 258 which ride in annular grooves 259 and 261 respectingly formed within the shaft and roller. After the balls are introduced through radial opening 262, it is closed by a welded plug 263. Preferably, the thrust bearing is adjacent to the top end 264 of the roller 256 but not close to the end of the roller where maximum sheer stress occurs.

Sealing mechanisms are provided to protect the radial and thrust bearing mountings between the roller and shaft. The lower end 265 of the roller is sealed to the shaft by an o-ring 266 mounted in an annular internal groove 267.

The upper end 264 of the roller is sealed to the shaft by an annular seal 268 (u-shaped, trade name Polypak) which is confined within the shaft by an annular skirted groove 269 formed in the roller. The upper end 264 overhangs the seal 268 and forms the upward abutment surface of the roller. The seal 268 is secured within the roller by a spring clip or ring 271 resting in internal groove 272. Preferably, the seal 268 and ring 271 are installed in the roller before the balls 258 are installed.

When the roller is journaled onto the shaft by the thrust and radial bearings, and the sealing means are in place, the assembly is preferably factory lubricated. For this purpose, the shaft is provided with a lubricant reservoir and pressure volume compensator 273.

The compensator 273 resides within an axial bore 274 extended partially into the shaft from the pin end 222. The compensator 273 has an elongated resilient bladder 276 with its closed end 277 upwardly placed in the bore 274 and its open end 278 secured in fluid tightened to the bore 274 by a ferule nut 279. A radial passage 281 places the annulus 282 between the bladder 276 and bore 274 in fluid communication with the thrust and radial bearings between the sealing rings 266 and 268.

The lubricant is placed into the compensator 273 with the following arrangement. An external vacuum system (not shown) is connected to a radial port 283 in the roller 256. After the air is withdrawn from the annulus 282, various passages and spaces between the sealing rings 266 and 268, the vacuum system is valved off and a source of fluid lubricant is connected with the port 283. The bladder which has expanded against the bore 274 is now partially collapsed as lubricant fills the open spaces from the port 283 inwardly into the compensator 273. Now, the lubricant source is removed and the port 283 sealed with a threaded plug 284.

With this arrangement of the compensator 273, the bladder can change shape to accommodate the specific volume changes in the lubricant (e.g., changes in temperature and pressure conditions). Furthermore, the sealing rings are protected against long destructive pressure differentials arising from the wellbore environments.

In order to remove the shaft and roller assembly from the body, a drive out tool 232 can be used. For this purpose, the pin ends 220 and 222 are provided with bevel surfaces 287 and 288 that extend at an angle (e.g., 30 degrees) from the flat bottom sides 248 and 249 to the flat ends 243 and 245. After the cap screws 224–226 are removed, the tip 289 of the tool 232 is inserted beneath the bevel surface and driven along the flat bottom of the slots in the body. As a result, the interference fit between the slots and shaft ends is overcome, and the shaft is released for removal from the body.

The arrangement of the subcombination 241 of shaft with mounted roller, and lubricant, can be assembled readily in plant facilities and transported to remote regions and drill sites for replacement directly on existing roller-reamer units without special tools or parts. No special tools or expert technicians are required for this field removal and replacement of this novel shaft and roller unit.

Although numerous embodiments have been shown and described, it will be understood that the invention is not limited thereto since many modifications may be made and will become apparent to those skilled in the art. The employment of tightly secured components, which are also releasable, results in the elimination of fretting which has heretofore caused rapid wearing of roller-reamer surfaces.

What is claimed is:

1. A roller-reamer unit subcombination for securing into a body of a roller-reamer borehole drilling apparatus, comprising:

(a) a roller-reamer and a shaft held in radial alignment by a radial bearing and in axial alignment by a thrust bearing;

(b) seal means between said roller and said shaft to retain a lubricant between said radial and thrust bearings and to exclude drilling fluid from said radial and thrust bearings;

(c) a lubricant reservoir and pressure volume compensator within said shaft;

(d) fluid communication means between said radial and thrust bearings and said lubricant reservoir;

(e) securing means on the ends of said shaft for directly attaching said shaft to the body with an interference fit; and (f) means to apply a large magnitude outwardly applied radial force to remove said shaft from its interference fit within the body.

2. The subcombination of claim 1, wherein said shaft at its end carries flat parallel sides with a dimension across the flats being slightly greater than mating flat parallel sides in the body within which said shaft when assembled has elastic deformation in the interference fit.

3. The subcombination of claim 1, wherein the ends of said shaft have radial opening at least at one end to accommodate fasteners means to hold said shaft radially inwardly within the body.

4. The subcombination of claim 1, wnerein said shaft has a tool engageable surface on at least one end to accommodate a wedge type driving tool for removal of said roller and said shaft from the body.

5. A roller-reamer unit subcombination for securing into a body of a roller-reamer borehole drilling apparatus, comprising:

(a) a roller end and a shaft held in radial alignment by a radial bearing and in axial alignment by a thrust bearing;

(b) seal means between said roller and said shaft to retain a lubricant between said radial and thrust bearings and to exclude drilling fluid from said radial and thrust bearings;

(c) a lubricant reservoir and pressure volume compensator within said shaft;

(d) fluid communication means between said radial and thrust bearings and said lubricant reservoir;

(e) securing means on the ends of said shaft for attaching said shaft to the body with an interference fit;

(f) means to apply a large magnitude outwardly applied radial force to remove said shaft from its interference fit within the body;

(g) said shaft at its ends carries flat parallel sides with a dimension between said sides being slightly greater than mating flat parallel sides in the body within which said shaft when assembled has elastic deformation in the interference fit;

(h) at least one end of said shaft have radial openings to accommodate fasteners means to hold said shaft radially inwardly within the body; and (i) said shaft has a tool engaging surface on at least on end to accommodate a wedge type driving tool for removal of said roller and said shaft from the body.

6. A roller-reamer unit subcombination for securing into a body of a roller-reamer borehole drilling apparatus, comprising:

(a) a roller-reamer shaft including means for releasably connecting said shaft to the body;

(b) said means including, at each end of said shaft, parallel flat side faces and a flat bottom face perpendicular to said side faces, and said faces elastically deformable upon mounting in the body of the roller-reamer unit;

(c) said bottom faces having bevelled surface at each end of said shaft, and said bevelled surfaces adapted to engage a driving tool for removing radially outwardly said shaft from the roller-reamer unit;

(d) said shaft having one end leading to a uniform diameter portion which terminates at a radial projection at an enlarged other end thereon;

(e) said shaft at each end provided with radial bore at least one end which pass perpendicularly through said bottom faces, and said bores adapted to accommodate cap screws for securing said shaft within the body of the roller-reamer unit:

(f) a cylindrical roller rotably securably about a portion of said shaft;

(g) said cylindrical roller having a cylindrical central bore to pass slideably over one end of said roller and mounted about said uniform diameter portion of said shaft and rest with one end adjacent said radial projection;

(h) radial bearing means and thrust bearing means located between said shaft and said roller;

(i) seal means between said roller and said shaft, said seal means located adjacent the ends of said roller; and said seal means retaining a lubricant between the radial and thrust bearing means;

(j) a lubricant reservoir and pressure volume compensator disposed internally within said shaft;

(k) fluid communication between said radial and thrust bearing means and said reservoir;

(l) said lubricant pressure volume compensator including a bladder with its open end secured in an axial bore at one end of said shaft;

(m) said shaft having an annular seal engaging surface adjacent said radial projection thereon;

(n) said roller having a skirted groove in its end facing said radial projection on said shaft;

(o) an annular seal received in said skirted groove forming said sealing means between said roller and said shaft adjacent said radial projections;

(p) a releasable ring securing said annular seal in said roller;

(q) said roller carrying an annular groove containing an annular sealing member for providing said sealing means to said shaft at the end of said roller remote from said radial projections; and (r) a removeable vent plug received in a radial bore within said roller and in fluid communication with said fluid communication between said radial and thrust bearing means and said reservoir whereby said reservoir and fluid communication between said radial and thrust bearing means can be evacuated, a lubricant introduced thereinto and sealed by said vent plug.

7. A roller-reamer unit subcombination for securing into the body of a roller-reamer borehole drilling apparatus, comprising:

(a) a roller-reamer shaft including means for releasably connecting said shaft to the body;

(b) said means including, at each end of said shaft, parallel flat side faces and a flat bottom face perpendicular to said side faces, and said faces elastically deformable upon mounting in the body of the roller-reamer unit;

(c) said bottom faces having bevelled surface at each end of said shaft, and said bevelled surfaces adapted to engage a driving tool for removing radially outwardly said shaft from the roller-reamer unit;

(d) said shaft having one end leading to a uniform diameter portion which terminates at a radial projection at an enlarged other end thereon;

(e) said shaft at each end provided with radial bore at least one end which pass perpendicularly through said bottom faces, and said bores adapted to accomodate screw means for securing said shaft within the body of the roller-reamer unit;

(f) a cylindrical roller rotably securably about a portion of said shaft;

(g) said cylindrical roller having a cylindrical central bore to pass slideably over said one end and mounted about said uniform diameter portion of said shaft and rest with one end adjacent said radial projection; and (h) radial bearing means and thrust bearing means located between said shaft and said roller.

* * * * *